US007553154B2

(12) United States Patent
Jones

(10) Patent No.: US 7,553,154 B2
(45) Date of Patent: Jun. 30, 2009

(54) CANDLE WICK METHOD

(76) Inventor: Kevin B. Jones, 2400 Seabreeze Ct., Orlando, FL (US) 32805

( * ) Notice: Subject to any disclaimer, the term of this patent is extended or adjusted under 35 U.S.C. 154(b) by 1027 days.

(21) Appl. No.: 10/932,184

(22) Filed: Sep. 1, 2004

(65) Prior Publication Data

US 2005/0048431 A1 Mar. 3, 2005

Related U.S. Application Data

(63) Continuation-in-part of application No. 10/342,593, filed on Jan. 15, 2003, now abandoned.

(51) Int. Cl.
*F23D 3/16* (2006.01)

(52) U.S. Cl. ..... 431/288; 431/289

(58) Field of Classification Search ..... 431/120, 431/288, 289, 291, 125; 425/803; 264/271.1, 264/259; 219/221, 227, 229, 231; 30/140; D26/7

See application file for complete search history.

(56) References Cited

U.S. PATENT DOCUMENTS

| | | | | |
|---|---|---|---|---|
| 1,883,726 | A | 10/1932 | Warren | 431/291 |
| 2,119,908 | A | 6/1938 | Ellis | |
| 2,454,576 | A | 11/1948 | Slack | 219/241 |
| 2,972,035 | A | 1/1961 | Miller | 30/140 |
| 3,002,077 | A | 9/1961 | Caliri | |
| 3,120,598 | A | 2/1964 | Westerback et al. | |
| 3,316,385 | A | 4/1967 | Anton | |
| 3,438,363 | A | 4/1969 | Milbrandt | 431/291 |
| 3,583,853 | A | 6/1971 | Schramm | 431/291 |
| 3,711,211 | A | 1/1973 | Garrison | |
| 3,821,513 | A | 6/1974 | Christensen | |
| 3,902,043 | A | 8/1975 | Rogan | 219/242 |
| 3,938,526 | A | 2/1976 | Anderson et al. | |
| 3,983,677 | A | 10/1976 | Lundbom | 425/803 |
| 4,074,110 | A | 2/1978 | Slaughter | 219/229 |
| 4,076,490 | A * | 2/1978 | Hilker | 431/125 |
| 4,301,357 | A | 11/1981 | Huffman | |

(Continued)

FOREIGN PATENT DOCUMENTS

| | | |
|---|---|---|
| DE | 856929 | 11/1952 |

(Continued)

OTHER PUBLICATIONS

The Candle Book. Laklan, Carli, Avenel Books, New York, 1956 pp. 23-27.

*Primary Examiner*—Steven B McAllister
*Assistant Examiner*—Sarah Suereth
(74) *Attorney, Agent, or Firm*—William M. Hobby, III

(57) ABSTRACT

A method for adding a candle wick to a candle includes selecting a wick cavity forming tool having a heated elongatable tip having a stopping edge formed thereon, then heating the elongated tip and inserting it into a wax candle to form a bore therein having softened wax therearound. A wick is inserted into the candle bore created by the heated wick cavity forming tool while the surrounding wax is still soft. Excess wax can then be removed from the candle so that the wick is formed in the candle. The process may also include removing an existing wick from the candle prior to adding a candle wick thereto and adding a plurality of wicks to a single candle and to the cutting of the wick to size.

4 Claims, 2 Drawing Sheets

U.S. PATENT DOCUMENTS

| | | | | |
|---|---|---|---|---|
| 5,073,696 | A | 12/1991 | Patillo et al. | |
| 5,537,989 | A | 7/1996 | York et al. | 126/406 |
| D412,368 | S * | 7/1999 | Gazzola et al. | D26/7 |
| D429,350 | S * | 8/2000 | Tingley | D26/7 |
| 7,037,104 | B2 * | 5/2006 | Azzinaro et al. | 431/2 |

FOREIGN PATENT DOCUMENTS

| | | |
|---|---|---|
| FR | 1466481 | 4/1967 |
| GB | 2 339 613 A | 2/2001 |
| WO | WO 01/42404 A2 | 6/2001 |

* cited by examiner

CANDLE WICK METHOD

This patent application is a continuation-in-part of U.S. patent application Ser. No. 10/342,593, filed Jan. 15, 2003 now abandoned for Candle Wick Method.

BACKGROUND OF THE INVENTION

The present invention relates to a process for replacing candle wicks in candles having poor wick burning or uneven wax consumption or the like.

In the past, candles typically have been made of wax having a wick extending along the center axis of the formed candle. The wick may be made of cotton or other material. However, candles often burn unevenly and thus rapidly become unusable because the wick is broken or burned off or unable to be burn due to becoming covered by wax.

The present invention solves these problems by providing a process for adding a new wick to a candle and also for trimming excess wax from the candle. A needle-like element is heated and inserted into the top of a candle to melt wax sufficiently for a wick to be inserted. The wax can then be solidified around the wick. In addition, multiple wicks can be placed within the candle and the heated needle-like element can be used to trim uneven wax. Candles can be initially molded without a wick to allow a person to add wicks after a candle has been made to thereby customize a candle as desired by the individual. This can also provide safer candles since many candle wicks contain zinc which can be harmful when burned and the present process allows for the insertion of a safer wick in the candle.

The following U.S. patents illustrate electrically heated tools for different purposes including wax shaping tools. The Anton patent, U.S. Pat. No. 3,316,385, shows an electric heating and soldering gun while the Caliri U.S. Pat. No. 3,002,077 is for a soldering tool. The Ellis U.S. Pat. No. 2,119,908 discloses a wax modeling tool for dental work that is heated with gas while the Westerback et al. U.S. Pat. No. 3,120,598 discloses another wax shaping tool for dental molds. It does not show a tip. The Huffman U.S. Pat. No. 4,301,357 shows another wax shaping tool. The Christensen U.S. Pat. No. 3,821,513 illustrates a wax carving tool with various heating tips. The Patillo et al. U.S. Pat. No. 5,073,696 shows an electrically heated wax shaping tool with different tips while the Anderson et al. U.S. Pat. No. 3,938,526 is for an electrically heated acupuncture needle. The German patent No. 856,929 shows a wax shaping tool.

In contrast to these prior patents, the present invention is for a method of adding a wick to an existing candle or to a block of wax and includes the steps of selecting a specific wick cavity forming tool having a heated elongated tip along with a shoulder to mark the insertion depth for the tip and then heating the elongated tip and inserting the elongated tip into a wax candle to form a bore therein having softened wax therearound so that the wick can be inserted into the candle bore while the surrounding candle wax is softened to either replace an existing candle wick or to add new candle wicks to an existing candle.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
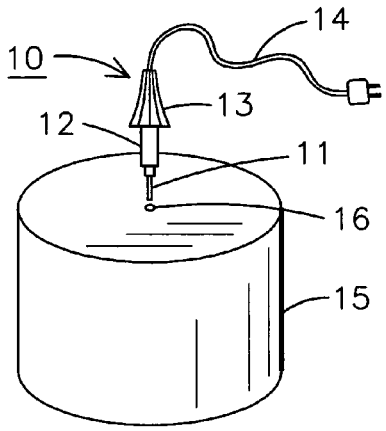
FIG. 1 is a perspective view of a candle having a heated wick burning tip being inserted into a candle.

Referring to the drawings and especially to FIG. 1, a wick hole burning tool 10 has a wick burning tip 11 mounted on the end of a heating element 12 and having a handle 13 with an electrical cord 14 extending therefrom for connection to a 110 voltage source or the like. The wick hole forming tool 10 can also be battery operated as desired. The tool 10 is shown placed over a candle 15 and has burned a hole 16 in the candle wax as shown so that a new candle wick can be placed within the hole 16 in the softened wax.

Figure 2:
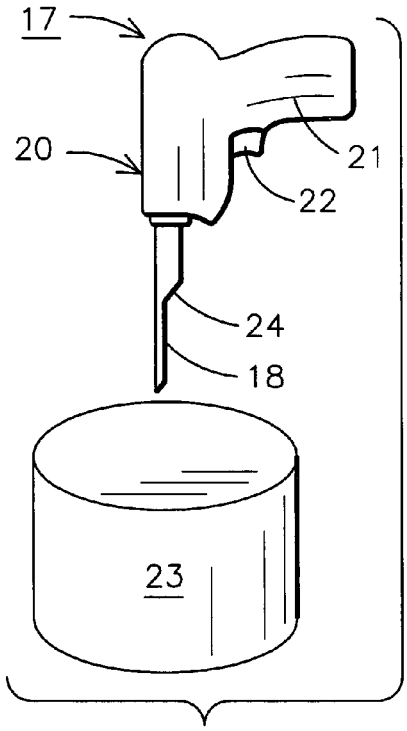
FIG. 2 is a perspective view of the first step of a process for placing a wick in a candle and has the heated wick burning tip positioned over a wax candle.
Figure 3:
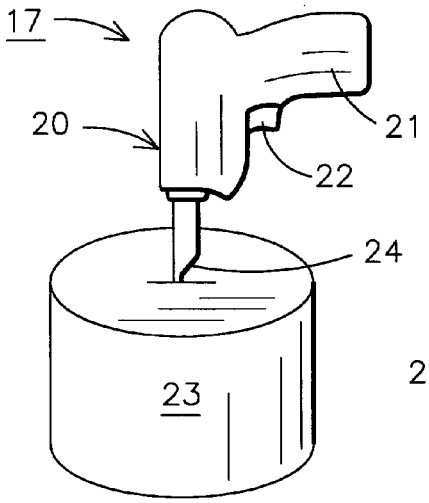
FIG. 3 is a perspective view of the wick hole being burned into the candle.
Figure 4:
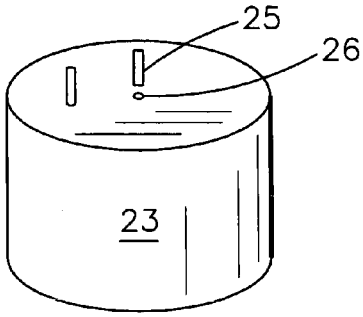
FIG. 4 illustrates the insertion of the wick into the candle.

Turning to FIGS. 2 through 5, the process of forming a wick into a candle and trimming the candle is illustrated. The process includes selecting a wick cavity forming tool 17 having a needle-like element 18 attached thereto and having a cylindrical shape for forming a wick cavity in a candle. The tool 17 has a heating portion 20 and a handle 21 as well as an activating switch or trigger 22 thereon. The wick cavity forming tool 17 is placed directly over a candle 23 that has a defective wick or no wick or in which the person wants to add additional wicks, as shown in FIG. 2. The trigger 22 is squeezed to activate the heating elements in the tool to heat the wick forming needle 18. The wick forming element 18 is then plunged into the candle 23, as shown in FIG. 3. The tip can be inserted typically for 1¾" into the wax of the candle 23 or to the edge of a stopping point 24 on the edge of the tool 17. A wick 25, as shown in FIG. 4, is then inserted into the cylindrical hole 26 of the candle 23. A 2" wick, for instance, can be inserted into the opening 26 and allowed to stand until the wax is cooled. The wick can then be cut off to about ¼" from the base 27 of the candle 23.

Precautions are typically taken not to place the wick closer than 1" from the edge of the candle unless it is a single wick burning candle and, where placing multiple wicks in a candle, it is desirable to place the wicks at least 1" from each other. When the wick is at the end of its burning life, it will fall over and extinguish itself. The remaining wick can then be removed while the wax is in a liquid or soft condition. A new wick may be placed in the candle when the wax is cooled. It may also be desirable to have a pair of wicks which can be alternatively burned and not burned to allow even wax consumption.

Figure 5:
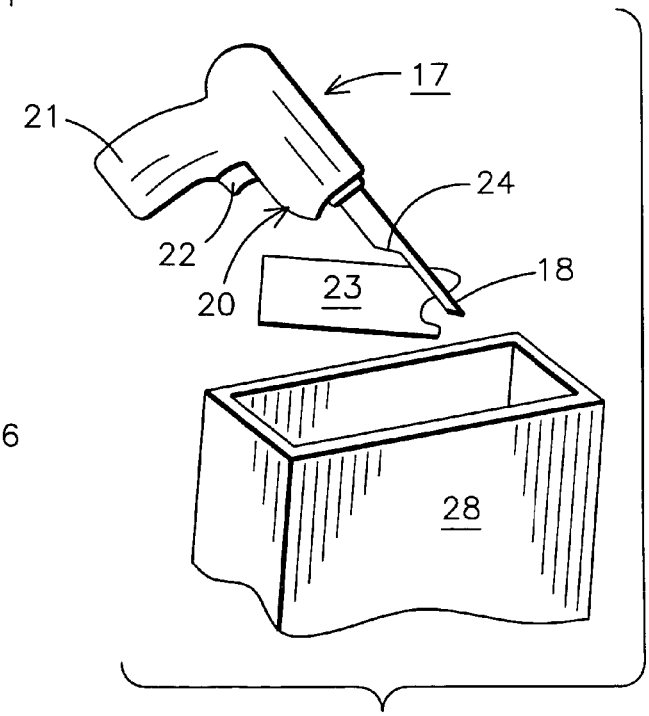
FIG. 5 is a perspective view of the candle wax being trimmed.

Turning specifically to FIG. 5, excess wax can be removed from the candle 23 in the final step of the process. A candle is held in a generally horizontal position over a waste container 28 and the heating tool 17 held at a generally 45 degree angle. Squeezing the trigger 22 activates the heating element to heat the wick forming tip 18. Once the tip 18 is heated, it can be used to cut or slice excess wax from the candle, as shown in FIG. 5. The melted wax during the trimming process can be allowed to drip into the trash container 28 along with the trimmed wax. The wax can then be allowed to cool to have a formed candle with a newly inserted wick.

Figure 6:
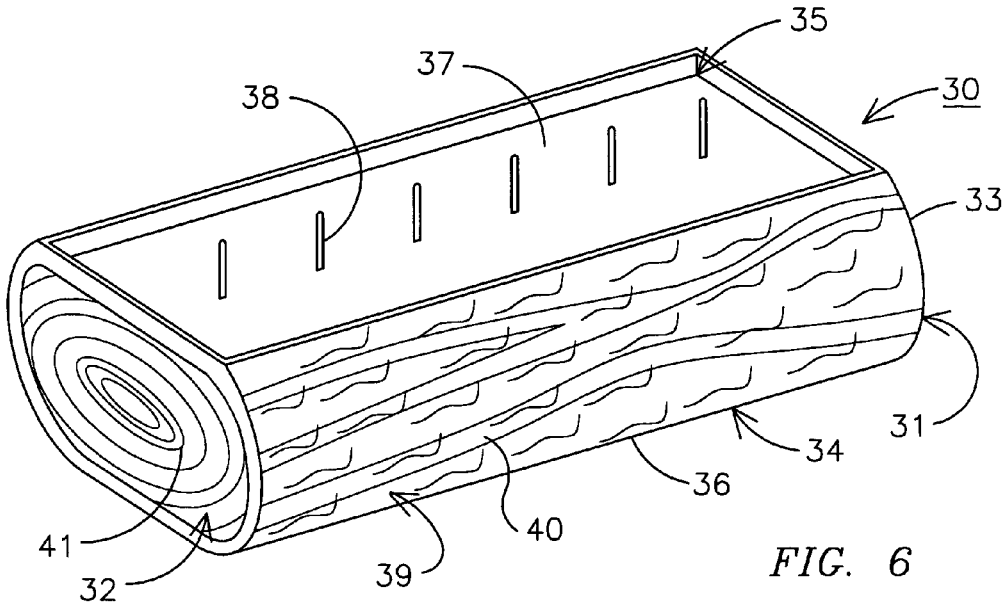
FIG. 6 is a perspective view of a fireplace candle.

Turning now to FIGS. 5 and 6, a fireplace candle 30 has a container 31 having an elongated body portion 34 and a pair of ends 32 and 33. The container 31 has an open top 35 and a flattened bottom 36. The open top 35 is filled with a wax 37 and has a plurality of candle wicks 38 mounted therein. The elongated body 34 has a simulated exterior in the shape of a wooden log with simulated bark 40 on the exterior sides 39 which have the same general coloring as bark. Each end 32 and 33 are flattened surfaces having tree ring 41 simulation thereon formed to look like a sawed log end.

Figure 7:
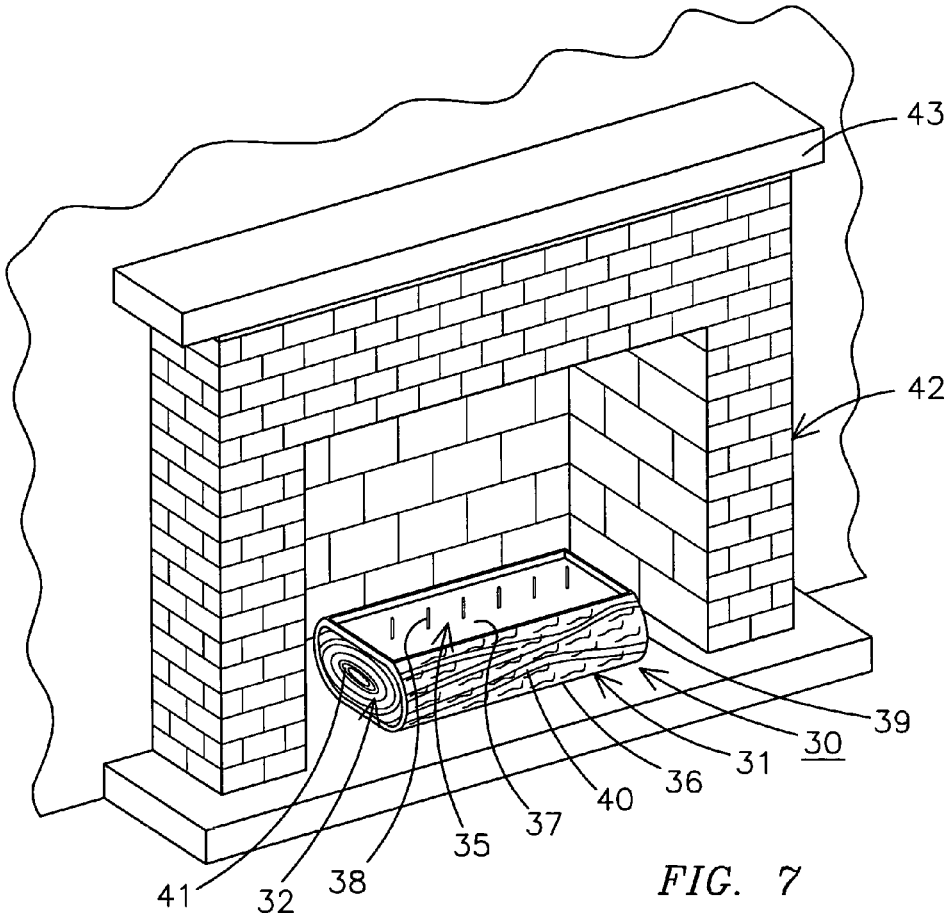
FIG. 7 is a perspective view of the fireplace candle of FIG. 6 placed in a fireplace.

The fireplace candle 30 is placed in the fireplace 42 having a mantle 43 in FIG. 7. The fireplace candle is placed in the fireplace 42 where the candles are lit to somewhat simulate a burning log.

The process of making the fireplace candle 30 includes selecting an elongated container 31 having ends 32 and 33 and an exterior shape simulating a wooden log and having simulated textured bark 40 on the sides 39 with the container having an elongated opening 35 therein. The container is partially filled with a wax 37 in the open side 35 and a plurality of wicks 38 are mounted in the wax 37 using the wick hole burning tool 10 and process of FIGS. 1-5 to form a fireplace candle. The additional step can include forming ends for the container 30 having a flattened surface 32 and 33 having tree rings 41 simulated on each end. The container 31 is refillable and new wicks can be added with the wicking process as set forth in connection with FIGS. 1-5 using the wick hole burning tool 10.

It should be clear at this time that a process of adding a new wick to an existing or new candle has been provided along with a process for trimming the candle wax to restore candles that would otherwise be discarded. However, the present invention should not be construed as limited to the forms shown which are to be considered illustrative rather than restrictive.

I claim:

1. A process for adding a candle wick to a candle including the steps of:

selecting a wick cavity forming tool having an electrically heatable, elongated tip and having a marked position to indicate the depth of the bore for a candle wick;

electrically heating said elongated tip;

removing an existing wick from a candle;

inserting said heated elongated tip into a wax candle to form a bore thereinto having softened wax therearound;

inserting a wick into the wax candle bore having softened wax therearound created by said heated wick cavity forming tool;

cutting said added wick; and removing excess wax from said candle with said electrically heated elongated tip;

whereby a wick is formed into a candle.

2. The process for adding a candle wick in accordance with claim 1 including the step of adding a plurality of wicks to a wax candle.

3. A process of making a fireplace candle comprising the steps of:

selecting an elongated container having an elongated body portion and two end portions and having an exterior shape of a wooden log with said body portion having a pair of walls having a simulated bark shape thereon, said container having an elongated opening in said elongated body portion;

filling said selected container at least partially full of wax;

selecting a wick cavity forming tool having an electrically heatable, elongated tip and having a marked position to indicate the death of the bore for a candle wick;

electrically heating said elongated tip;

inserting said heated elongated tip into the wax in said selected container a plurality of times to form a plurality of bores thereinto having softened wax therearound;

inserting a wick into each wax bore having softened wax therearound created by said heated wick cavity forming tool; and cutting each said added wick;

to thereby form a multiwicked fireplace candle.

4. The process of making a fireplace candle in accordance with claim 3 in which said step of selecting an elongated container includes selecting an elongated container having said two end portions having a generally flat end having the appearance of a simulated sawn wooden log end.

* * * * *